United States Patent [19]

Kimura

[11] 3,985,629

[45] Oct. 12, 1976

[54] METHOD FOR COLOR-ANODIZING ALUMINUM AND ALUMINUM ALLOYS IN A SHORT PERIOD OF TIME

[75] Inventor: Shozo Kimura, Osaka, Japan

[73] Assignee: Toyo Chuo Kagaku Kenkyusho, Japan

[22] Filed: June 18, 1975

[21] Appl. No.: 588,009

[30] Foreign Application Priority Data

June 29, 1974 Japan ..... 49-74633

[52] U.S. Cl. ..... 204/58

[51] Int. Cl.[2] ..... C25D 11/10

[58] Field of Search ..... 204/58

[56] References Cited

UNITED STATES PATENTS

| | | | |
|---|---|---|---|
| 3,265,597 | 8/1966 | Neunzig et al. | 204/58 |
| 3,280,013 | 10/1966 | Economy | 204/58 |
| 3,328,274 | 6/1967 | Bushey et al. | 204/58 |
| 3,384,561 | 5/1968 | Michelson et al. | 204/58 |
| 3,425,918 | 2/1969 | Zweifel et al. | 204/58 |

*Primary Examiner*—R. L. Andrews

*Attorney, Agent, or Firm*—Stevens, Davis, Miller & Mosher

[57] ABSTRACT

A method for color-anodizing (hereinafter referred merely to "coloring") aluminum and aluminum alloys in a short period of time. The method comprises adding sulfosalicylic acid or sulfophthalic acid and along with sulfuric acid to a solution, of which the main ingredient is citric acid, succinic acid, to form an electrolyte and effecting anodic oxidation on surfaces of aluminum and aluminum alloys with the electrolyte to form a colored oxide coating.

1 Claim, No Drawings

METHOD FOR COLOR-ANODIZING ALUMINUM AND ALUMINUM ALLOYS IN A SHORT PERIOD OF TIME

This invention relates to an improved method for coloring and electrolyzing aluminum and aluminum alloys.

The method according to the present invention is capable of reducing the time required for coloring aluminum and aluminum alloys and the quantity of electric current required for electrolysis process, over that required by the prior art.

BACKGROUND OF THE INVENTION

In conventional methods for coloring and electrolyzing aluminum and aluminum alloys, electrolytic time requires, for example, more than 30 minutes, and in addition, an energy quantity generally, more than 1.5 Ampere/dm$^2$, which results in a high cost for the finished aluminum and aluminum alloy.

It is therefore an object of this invention to improve conventional methods as noted above and to provide a method for coloring aluminum and aluminum alloys, which can cut electrolytic time and minimize the energized quantity required for electrolysis.

BRIEF SUMMARY OF THE INVENTION

The present invention provides a method for coloring aluminum and aluminum alloys which comprises adding sulfosalicylic acid and/or sulfophthalic acid along with sulfuric acid to a solution, of which the main ingredient is citric acid, succinic acid, to form an electrolyte; and effecting anodic oxidation on surfaces of aluminum and aluminum alloys with the electrolyte to form a colored oxide coating in a shorter period of time than is required by the prior arts.

Although a combination of citric acid, succinic acid, sulfocitric acid or sulfosuccinic acid (each being a treating agent as a main ingredient) and sulfosalicylic acid or sulfophthalic acid (each being a treating agent to be added), as noted above, may variously be considered as the case may be, there exists no difference in function of the coloring reaction in any case.

In accordance with the present method, the sulfosalicylic acid or sulfophthalic acid (treating agent to be added) serves to facilitate coloring of the anodic oxidation coating of aluminum and aluminum alloys, to cut electrolytic time and to minimize the energy quantity that is required.

DETAILED DESCRIPTION

The present invention will become more apparent from the following description.

As described above, the electrolyte employed in the method of the present invention may variously be combined as follows:

Citric acid, sulfosalicylic acid, and sulfuric acid;
Citric acid, sulfophthalic acid, and sulfuric acid;
Succinic acid, sulfosalicylic acid, and sulfuric acid;
Succinic acid, sulfophthalic acid, and sulfuric acid;

The detail of coloring reaction of electrolyte according to the respective combinations is given in the examples later described.

Various particulars used in the present method are given as follows:

| | |
|---|---|
| Concentration of solution, of which main ingredient is citric acid or succinic acid | 5 – 100 g/lit. |
| Quantity of addition where sulfosalicylic acid or sulfophthalic acid is added as an additive | 1 – 30 g/lit. |
| Quantity of sulfuric acid | 0.1 – 5.0 ml/lit. |
| Liquid temperature of electrolyte | 10 – 40°C |
| Density of electric current | 0.5 – 2.0 A/dm$^2$ In case of DC |
| 0.5 – 2.0 A/dm$^2$ D.C. plus 0.1 – 2.0 A/dm$^2$ A.C. | |

The method of the present invention was carried out in accordance with the above-described particulars, and as a result, it has been proved that a standard energized quantity which was enough to accomplish this process was 0.5 – 1.0 A/dm$^2$ and the electrolytic time was 5 – 15 minutes to insure a color tone similar to that of conventional colored products.

In conventional methods for electrolyzing and coloring, merely one row of workpieces which are anode could be treated in the intermediary of cathodes, whereas in the method of the present invention, even two rows of workpieces could be treated between cathodes without creating substantial irregularities of color tone.

From the foregoing, it will be appreciated that the method of the present invention may increase the efficiency of production and decrease the cost of production.

Examples of the present invention will now be described in the following:

EXAMPLE 1

| | |
|---|---|
| Electrolyte composition | |
| Citric acid | 50 g/lit. |
| Sulfuric acid | 0.5 ml/lit. |
| Sulfosalicylic acid | 20 g/lit. |
| Liquid temperature | 20°C ± 2°C |
| Electrolytic time | 10 minutes |
| Density of electric current | 0.5 A/dm$^2$ – 1.5 A/dm$^2$ DC |
| Materials used | |
| Aluminum alloy 63S in accordance with the Japanese Industrial Standard is composed of: (Aluminum alloy 6063 in America) | |
| Copper | Less than 0.1 % |
| Silicon | 0.2 – 0.6 % |
| Iron | Less than 0.35 % |
| Manganese | Less than 0.1 % |
| Magnesium | 0.45 – 0.09% |
| Zinc | 0.1 % |
| Bromine | Less than 0.1 % |
| Titanium | Less than 0.1 % |
| Aluminum | The remainder |

(The same is true for the following examples.)

The test results obtained by the aforementioned particulars are as follows:

| DENSITY OF ELECTRIC CURRENT | FINAL VOLTAGE | COLOR TONE | THICKNESS OF COATING |
|---|---|---|---|
| 0.50 A/dm$^2$ | 60 V | Amber | 2 micron |
| 0.75 A/dm$^2$ | 71 V | Amber | 3 micron |
| 1.00 A/dm$^2$ | 76 V | Amber | 4 micron |
| 1.50 A/dm$^2$ | 85 V | Somewhat dark amber | 6 micron |

EXAMPLE 2

| | |
|---|---|
| Electrolyte composition Same as Example (1) | |
| Liquid Temperature | 12°C – 40°C |
| Density of electric current | 1.0 A/dm² DC |
| Electrolytic time | 10 minutes |

The test results obtained by the aforementioned particulars are as follows:

| LIQUID TEMP. | FLUCTUATION OF LIQUID TEMP. | FINAL VOLTAGE | COLOR TONE |
|---|---|---|---|
| 12°C | 12 – 13°C | 86 V | Pale amber |
| 15°C | 14.5 – 15.1°C | 85 V | Pale amber |
| 20°C | 19.5 – 20.5°C | 76 V | Medium amber |
| 30°C | 29.0 – 31.0°C | 71 V | Somewhat dark amber |
| 40°C | 39.5 – 40.5°C | 60 V | Dark amber |

As shown in this example (2), coloring can satisfactorily be achieved even at a high level of liquid temperature i.e. much higher than a standard value of electrolyte temperature generally in use such as 40° C above.

EXAMPLE 3

| Electrolyte composition | Same as Example (1) |
|---|---|
| Liquid temperature | 20°C ± 2°C |
| Density of electric current | 1.0 A/dm² DC |
| Electrolytic time | 5 – 40 minutes |

The test results obtained by the aforementioned particulars are as follows:

| ELECTROLYTIC TIME | FINAL VOLTAGE | COLOR TONE | THICKNESS OF COATING |
|---|---|---|---|
| 5 minutes | 55V | Pale amber | 2 micron |
| 10 minutes | 76 V | Medium amber | 4 micron |
| 20 minutes | 102 V | Dark amber | 8 micron |
| 30 minutes | 120 V | Bronze | 12 micron |
| 40 minutes | Over 125 V | Somewhat black | 16 micron |

In order to obtain a dark color darker than the dark amber in accordance with the prior art methods, a thickness of coating of more than 25 micron and an electrolytic time more than 40 minutes is required. In accordance with the present method, the dark color darker than the dark amber is produced within 20 minutes.

EXAMPLE 4

| | |
|---|---|
| Electrolyte composition | |
| Citric acid, 50 g/lit. | |
| Sulfuric acid, 0.5 ml/lit. | |
| Sulfosalicylic acid, 1.0 g/lit. – 30 g/lit. | |
| Liquid temperature | 20°C ± 2°C |
| Electrolytic time | 10 minutes |
| Density of electric current | 1 A/dm² DC |

The test results obtained by the aforementioned particulars are as follows:

| QUANTITY OF ADDITION OF SULFOSALICYLIC ACID | FINAL VOLTAGE | COLOR TONE |
|---|---|---|
| 1.0 g/lit. | 73 V | Dark amber |
| 5.0 g/lit. | 74 V | Somewhat dark amber |
| 10.0 g/lit. | 75 V | Medium amber |
| 20.0 g/lit. | 76 V | Medium amber |
| 30.0 g/lit. | 78 V | Medium amber |

When sulfosalicylic acid is added in a quantity of less than 0.5 g/lit., a chapping pattern appears, and where it is added in a quantity of less than 0.2 g/lit., coloring is only partially produced and a pattern of the grain of the wood appears.

EXAMPLE 5

| | |
|---|---|
| Electrolyte composition | |
| Citric acid | 5 g/lit. – 100 g/lit. |
| Sulfuric acid | 0.5 ml/lit. |
| Sulfosalicyclic acid | 20 g/lit. |
| Liquid temperature | 20°C ± 2°C |
| Electrolytic time | 10 minutes |
| Density of electric current | 1 A/dm² DC |

The test results obtained by the aforementioned particulars are as follows:

| QUANTITY OF ADDITION OF CITRIC ACID | FINAL VOLTAGE | COLOR TONE |
|---|---|---|
| 5 g/lit. | 70 V | Medium amber |
| 10 g/lit. | 70 V | " |
| 30 g/lit. | 75 V | " |
| 50 g/lit. | 76 V | " |
| 60 g/lit. | 80 V | " |

Where citric acid is added in a quantity in the range of from 5 g/lit. to 20 g/lit., a somewhat rough pattern appears, but practical use is not affected thereby. Most stabilized coloring may be obtained by the addition of citric acid in the range of from 40 g/lit. to 60 g/lit. with the electrolytic time extended, and in this case, the workpiece can be colored evenly.

EXAMPLE 6

| | |
|---|---|
| Electrolyte composition | |
| Citric acid | 50 g/lit. |
| Sulfuric acid | 0.3 – 0.6 m/lit. |
| Sulfosalicylic acid | 20 g/lit. |
| Liquid temperatue | 20°C ± 2°C |
| Electrolytic time | 10 minutes |
| Density of electric current | 1 A/dm² DC |

The test results obtained by the aforementioned particulars are as follows:

| QUANTITY OF ADDITION OF CITRIC ACID | FINAL VOLTAGE | COLOR TONE |
|---|---|---|
| 0.3 ml/lit. | 100 V | Yellowish amber |
| 0.4 ml/lit. | 85 V | Amber |
| 0.5 ml/lit. | 76 V | Amber |
| 0.6 ml/lit. | 60 V | Darkish amber |

EXAMPLE 7

| Electrolyte composition | |
|---|---|
| Succinic acid | 30 g/lit. |
| Sulfuric acid | 0.18 ml/lit. |
| Sulfosalicylic acid | 10 g/lit. |
| Liquid temperature | 20°C + 2°C |
| Density of electric current | 1.0 A/dm² DC |
| Electrolytic time | 2.5 minutes to 15 minutes |

The test results obtained by the aforementioned particulars are as follows:

| ELECTROLYTIC TIME | FINAL VOLTAGE | COLOR TONE |
|---|---|---|
| 2.5 minutes | 90 V | Pale indigo amber |
| 5 minutes | 102 V | Medium indigo amber |
| 10 minutes | 115 V | Amber |
| 15 minutes | 132 V | Amber |

EXAMPLE 8

| Electrolyte composition | |
|---|---|
| Citric acid | 30 g/lit. |
| Sulfuric acid | 0.18 ml/lit. |
| Sulfophthalic acid | 10 g/lit. |
| Liquid temperature | 20°C ± 2°C |
| Density of electric current | 1.0 A/dm² DC |
| Electrolytic time | 2.5 minutes – 15 minutes |

The test results obtained by the aforementioned particulars are as follows:

| ELECTROLYTIC TIME | FINAL VOLTAGE | COLOR TONE |
|---|---|---|
| 2.5 minutes | 93 V | Pale indigo amber |
| 5 minutes | 105 V | Medium indigo amber |
| 10 minutes | 117 V | Amber |
| 15 minutes | 135 V | Amber |

What is claimed is:

1. A method for color-anodizing aluminum and aluminum alloys to form a colored oxide coating comprising subjecting the surfaces of said aluminum and aluminum alloys to anodic oxidation with D.C. current having a density of 0.5 – 2.0 A/dm² in an electrolyte which contains 5 to 100 g/lit of electrolyte of citric acid or succinic acid, 1 to 30 g/lit of electrolyte of sulfosalicylic acid or sulfophthalic acid and 1 to 5.0 ml/lit of electrolyte of sulfuric acid.

* * * * *